US007721976B2

(12) United States Patent
Nolte et al.

(10) Patent No.: US 7,721,976 B2
(45) Date of Patent: May 25, 2010

(54) HIGH SPEED ROTATING ATOMIZER ASSEMBLY

(75) Inventors: Hans J. Nolte, Besigheim (DE); Harry Krumma, Bönnigheim (DE); Frank Herre, Oberriexingen (DE); Michael Baumann, Flein (DE); Stefano Giuliano, Gerlingen (DE); Bjorn Lind, Gotebörg (SE)

(73) Assignee: Durr Systems, Inc., Plymouth, MI (US)

( * ) Notice: Subject to any disclaimer, the term of this patent is extended or adjusted under 35 U.S.C. 154(b) by 1133 days.

(21) Appl. No.: 11/250,303

(22) Filed: Oct. 14, 2005

(65) Prior Publication Data

US 2006/0208102 A1 Sep. 21, 2006

Related U.S. Application Data

(63) Continuation-in-part of application No. 10/895,446, filed on Dec. 17, 2003, now Pat. No. 7,131,601, and a continuation-in-part of application No. 10/624,586, filed on Jul. 22, 2003, now Pat. No. 7,036,750.

(30) Foreign Application Priority Data

Jul. 22, 2002 (DE) ..... 102 33 198
Aug. 6, 2002 (DE) ..... 102 36 017

(51) Int. Cl.
*F23D 11/04* (2006.01)

(52) U.S. Cl. ..... 239/224; 239/222.11; 239/222.17; 239/380; 239/381; 239/700; 239/702

(58) Field of Classification Search ..... 239/690–708, 239/222.11, 223, 224, 290, 380, 463, 381
See application file for complete search history.

(56) References Cited

U.S. PATENT DOCUMENTS 4,368,853 A 1/1983 Morishita et al.
4,555,058 A * 11/1985 Weinstein et al. ..... 239/223
5,346,139 A 9/1994 Davis et al.
5,397,063 A * 3/1995 Weinstein ..... 239/703
5,421,518 A 6/1995 Robisch et al.

(Continued)

FOREIGN PATENT DOCUMENTS

EP 0359383 A2 3/1990

*Primary Examiner*—Dinh Q Nguyen
(74) *Attorney, Agent, or Firm*—Howard & Howard Attorneys PLLC

(57) ABSTRACT

An atomizer assembly (10) drives an atomizing bell (108) to apply paint onto a part (14). The atomizer assembly (10) includes a core (24) having at least one paint line (26) extending therethrough, a turbine device (40) circumscribing an axis (A) and disposed in the core (24), and a turbine unit (62) surrounding the pain line (26) and having a shaft (104) rotatable relative the turbine device (40) with several turbine blades (130) connected to the shaft (104). A plurality of nozzles (64, 66, 68) are defined in the turbine device (40) and are positioned relative a turbine wheel (106) connected to the shaft (104) to drive fluid, i.e. gas onto the turbine blades (130). An annular wall (94) extends outwardly from one of the terminal ends of the turbine device (40) to define a seat (96) for engaging the core (24) to maintain a fixed gap between the paint line (26) and the shaft (104) and to eliminate contact therebetween.

12 Claims, 6 Drawing Sheets

68

U.S. PATENT DOCUMENTS 5,584,435 A 12/1996 Lind
5,697,559 A 12/1997 Davis et al.
5,727,735 A 3/1998 Baumann et al.
5,775,598 A 7/1998 Takayama et al.
5,853,126 A * 12/1998 Alexander ..... 239/223
5,897,060 A 4/1999 Kon et al.
5,941,457 A 8/1999 Nakazono et al.
5,947,377 A 9/1999 Hansinger et al.
6,050,499 A 4/2000 Takayama et al.
6,053,437 A 4/2000 Hansinger et al.
6,189,804 B1 2/2001 Vetter et al.
6,250,567 B1 * 6/2001 Lewis et al. ..... 239/292
6,623,561 B2 9/2003 Vetter et al.
6,627,266 B2 9/2003 Dion
RE38,526 E 6/2004 Hansinger et al.
6,811,094 B2 11/2004 Kon et al.
2003/0010840 A1 1/2003 Kon et al.
2003/0080206 A1 5/2003 Duerr
2004/0129799 A1 7/2004 Krumma et al.
2004/0144860 A1 7/2004 Nolte et al.
2005/0001077 A1 1/2005 Kon et al.

* cited by examiner

HIGH SPEED ROTATING ATOMIZER ASSEMBLY

RELATED APPLICATION

This application is a continuation in part application of a co-pending patent application Ser. No. 10/895,446 filed on Dec. 17, 2003 and an allowed application Ser. No. 10/624,586 filed on Jul. 22, 2002, all of which are incorporated herewith by reference.

FIELD OF THE INVENTION

This invention relates to a bearing unit of a rotating atomizer for driving a bell cup coupled to the turbine device for coating a part.

BACKGROUND OF THE INVENTION

A production paint application process where paint is applied to a substrate, such as, for example a vehicle body moving through a paint booth, requires paint to be transferred from a paint reservoir to a paint applicator robot disposed in the paint booth, where paint is applied by a rotary atomizer as an integral part of the paint applicator robot. Typically, the rotary atomizer includes a turbine device disposed in a housing, a rotating bell unit having a shaft connected to a bell cup and disposed in and rotatable relative to the turbine device and the housing. The bell cup has a generally conical overflow surface between a radially inward central axial opening and a radially outward atomizing edge. At or near the radially outward atomizing edge, the angle of the overflow surface relative to the axis of the bell cup decreases sharply to form a lip adjacent the atomizing edge. The purpose of this lip is to generally direct the atomized paint more axially forward and reduce radial scatter. Typically, an air shaping ring is attached to the turbine device to improve distribution of the paint onto the vehicle body being painted.

The art is replete with prior art designs of an air shaping rings for a rotary atomizer. The U.S. Pat. No. 5,775,598 to Takayama et al.; U.S. Pat. No. 5,727,735 to Baumann et al.; U.S. Pat. No. 6,189,804 and U.S. Pat. No. 6,623,561 both to Vetter et al.; and the United States Patent Publication Nos. 2005/0001077 and 2003/0010840 both to Kon et al. The United States Patent Publication No. 2005/0001077 to Kon et al., for example, teaches a rotary atomizer having a housing, a turbine device disposed in the housing, a bell unit disposed in and rotatable relative the turbine device. An air shaping ring is disposed about the turbine device and is connected to the housing by a partially threaded fastener extending to a hook to interconnect the air shaping ring with the housing. This design is complex and requires additional component, such as the aforementioned fastener to interconnect the housing with the air shaping ring.

The U.S. Pat. No. 6,623,561 to Vetter et al., on the other hand, teaches a rotary atomizer having a housing, a turbine device disposed in the housing, a bell unit disposed in and rotatable relative the turbine device. An air shaping ring is disposed about the turbine device and between the turbine device and the housing. The air shaping ring of the U.S. Pat. No. 6,623,561 to Vetter et al. does not require additional components, such as, for example, partially threaded fastener extending to a hook, taught by the United States Patent Publication No. 2005/0001077 to Kon et al. to interconnect the air shaping ring with the housing. Hence, the air shaping ring and the turbine device taught by the U.S. Pat. No. 6,623,561 to Vetter et al. do not provide for constant surface to surface contact between the air shaping ring and the turbine device. In addition, none of the prior art patents teaches an improved design of the atomizer having improved rigidly stabilized connection between the turbine device and the housing for maintaining a fixed air gap between the shaft and a paint pipe or line extending through the shaft for keeping the shaft at a fixed distance relative to the paint line as the shaft rotates around the axis.

The goal of the invention is therefore to provide an improved design of the turbine device to eliminate at least one of the aforementioned problems associated with prior art atomizers.

SUMMARY OF THE INVENTION

An atomizer assembly of the present invention fluidly communicates with a fluid source to coat a part, such as, for example, a body of an automotive vehicle. The atomizer assembly includes a housing having at least one fluid line, i.e. paint line connected to the housing and extending therethrough, a turbine device having terminal ends and surrounding an axis and disposed in the housing. An atomizing bell unit has a shaft and an atomizing bell connected to the shaft and is fluidly communicated with the paint line for applying the paint to the body of the automotive vehicle. The atomizing bell unit is disposed in the turbine device surrounding the axis and rotatable around the axis and relative the turbine device. The atomizer bell unit presents terminal ends with one terminal end exposed to the fluid source and the other terminal exposed to the body of the automotive vehicle being coated.

The turbine device includes an annular wall extending outwardly from one of the terminal ends of the turbine device. The annular wall circumscribes the atomizing bell unit. The annular wall and the terminal end of the bearing define a seat for engaging the housing to provide a rigidly stabilized connection between the turbine device and the housing thereby maintaining a fixed annular gap between the shaft and the paint line extending through the shaft of the atomizing bell unit at a fixed distance relative to the paint line as the shaft rotates around the axis. A potential member is disposed around the bearing at the atomizing bell for concentrating the paint particles as the paint is applied to the body of the automotive vehicle. A biasing device is disposed in the turbine device for interconnecting the turbine device and the potential member for improved path of continuity and for providing constant surface to surface contact between the turbine device and the potential member as the fluid is applied to the part.

An advantage of the present invention is to provide an annular wall that extends outwardly from the turbine device defining a seat for engaging the housing thereby forming a rigidly stabilized connection between the turbine device and the housing, which have proven to maintain a fixed gap between the shaft of the rotational bell unit and the paint line for keeping the shaft at a fixed distance relative to the paint line to prevent contact between the paint line and the shaft.

Another advantage of the present invention is to provide the turbine device having an improved surface-to-surface contacts between the potential member and the turbine device to improve ionization of the atomized fluid particles.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
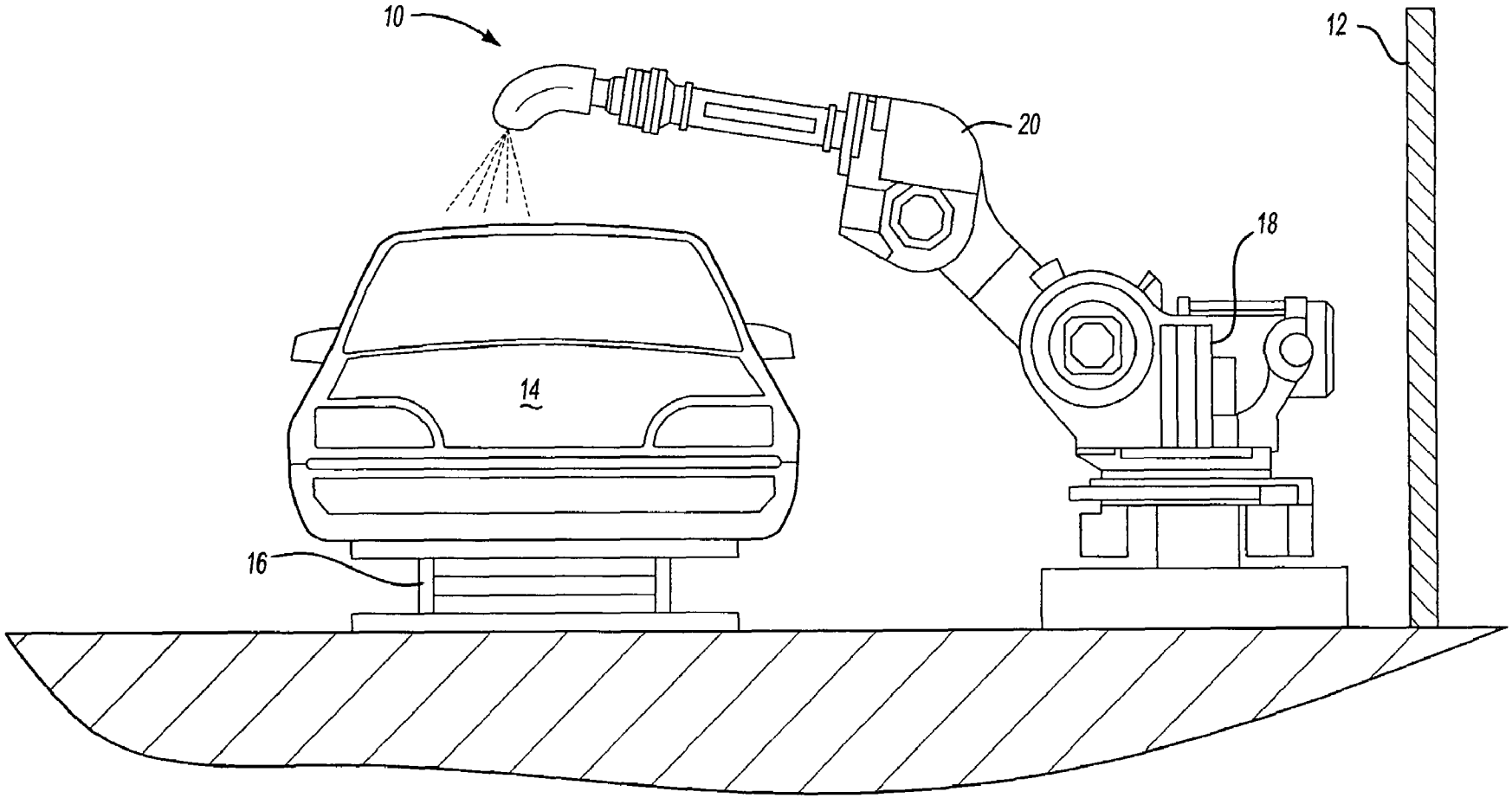
FIG. 1 illustrates a rotating atomizer on a robotic arm positioned next to a vehicle body in a paint shop.
Figure 2:
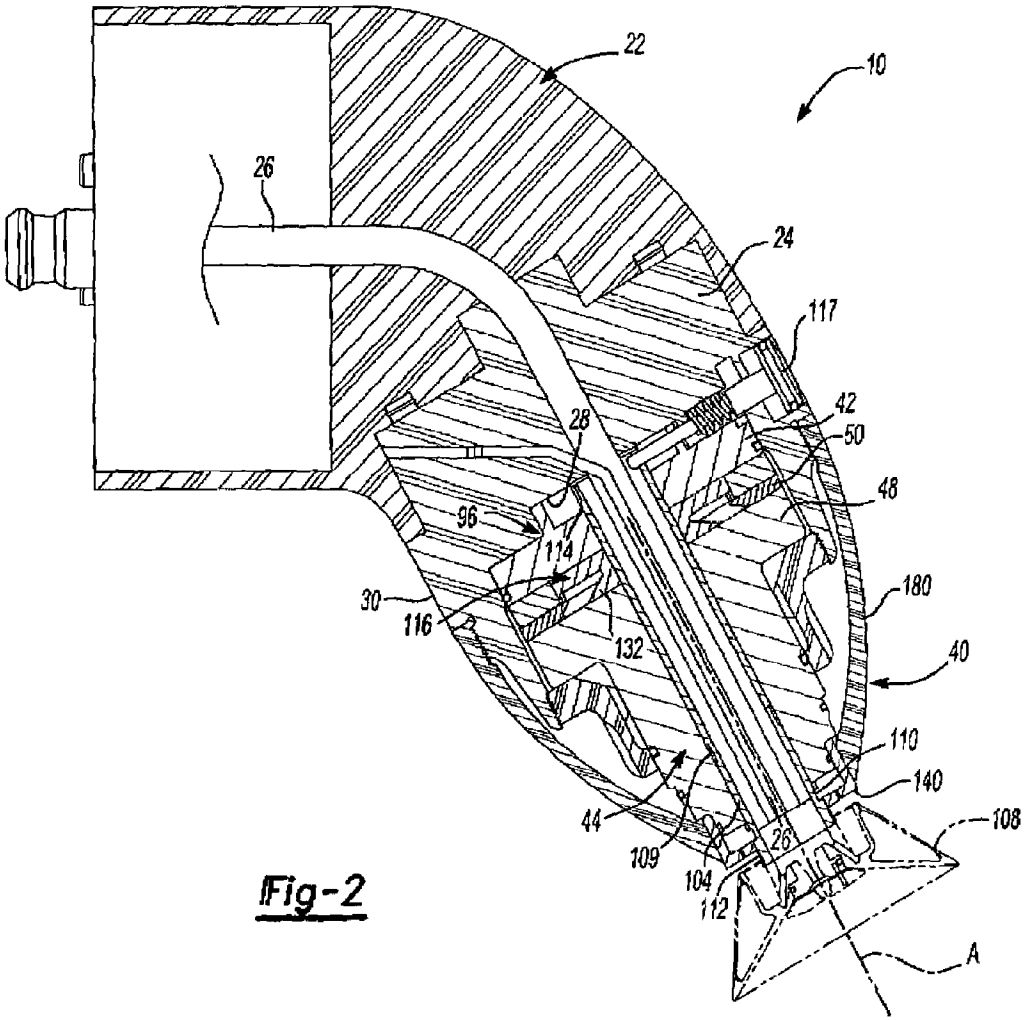
FIG. 2 is a cross sectional view of a turbine device installed in a turbine housing.

Referring to the FIGS. 1 and 2, wherein like numerals indicate like or corresponding parts, an inventive atomizer assembly is generally shown at 10. A paint circulation system (not shown) supplies paint to a paint booth 12 where the paint is applied to a production part, such as, for example, a vehicle body 14. In a typical automobile assembly plant the vehicle body 14 is transported through the paint spray booth 12 by conveying equipment 16 where the paint is applied to the vehicle body 14 and subsequently cured in a paint oven (not shown) as is known to those skilled in the art. The paint is applied by automated application equipment, such as a robotic device 18 that includes the atomizer assembly 10 that is connected to an arm 20 of the robotic device 18. Alternatively, the atomizer assembly 10 is operably connected to an overhead or side reciprocator (not shown).

Figure 3:
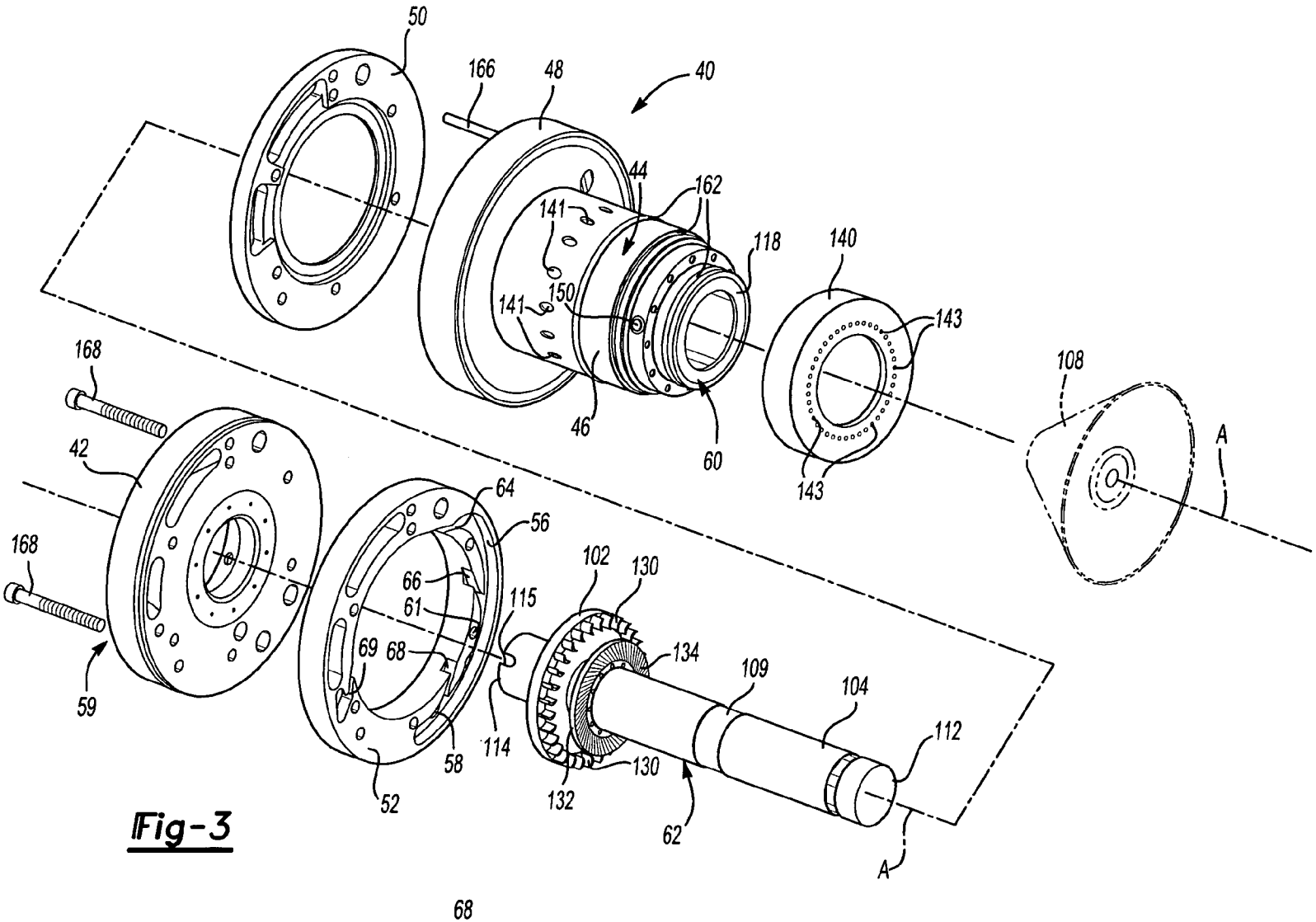
FIG. 3 is a perspective and exploded view of the turbine device shown in FIG. 2.
Figure 4:
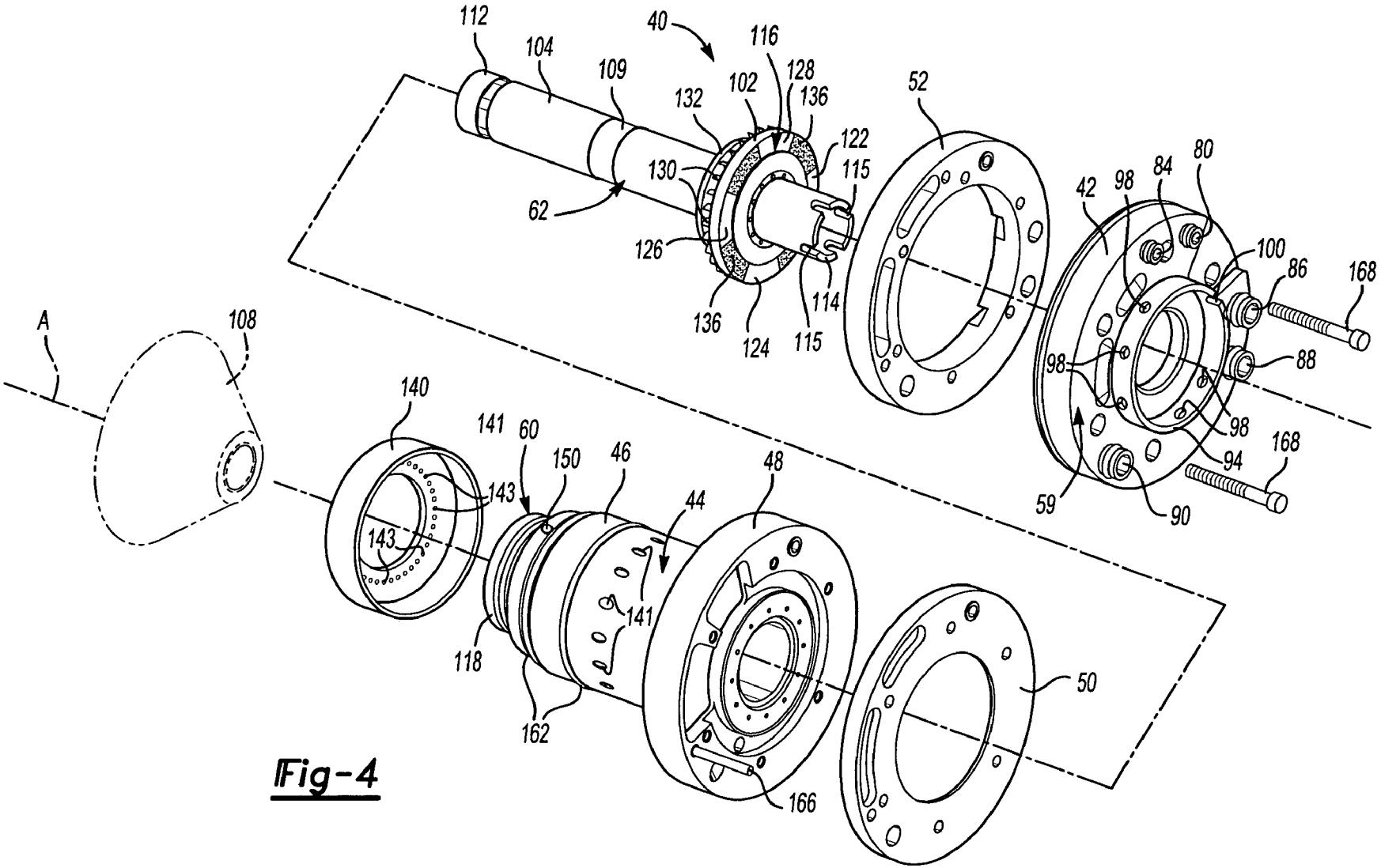
FIG. 4 is a perspective and exploded view of the turbine device.

Referring to FIGS. 2 through 4, the atomizer assembly 10 includes a housing, generally indicated at 22 in FIG. 2, having a curved configuration. The housing 22 is defined by a plurality of detachable components with one of these components, i.e. core member 24, as shown in FIG. 2, surrounding an axis A. The core member 24 is disposed in the housing for engaging at least one paint delivery line or a feed unit 26 fluidly communicated with a paint source (not shown). The core member 24 presents in interior surface 28 defined between annular side wall 30 of the core member 24. A turbine device, generally shown at 40, is the actual drive element of the high speed atomizer assembly 10 and is disposed in the core member 26.

Figure 5:
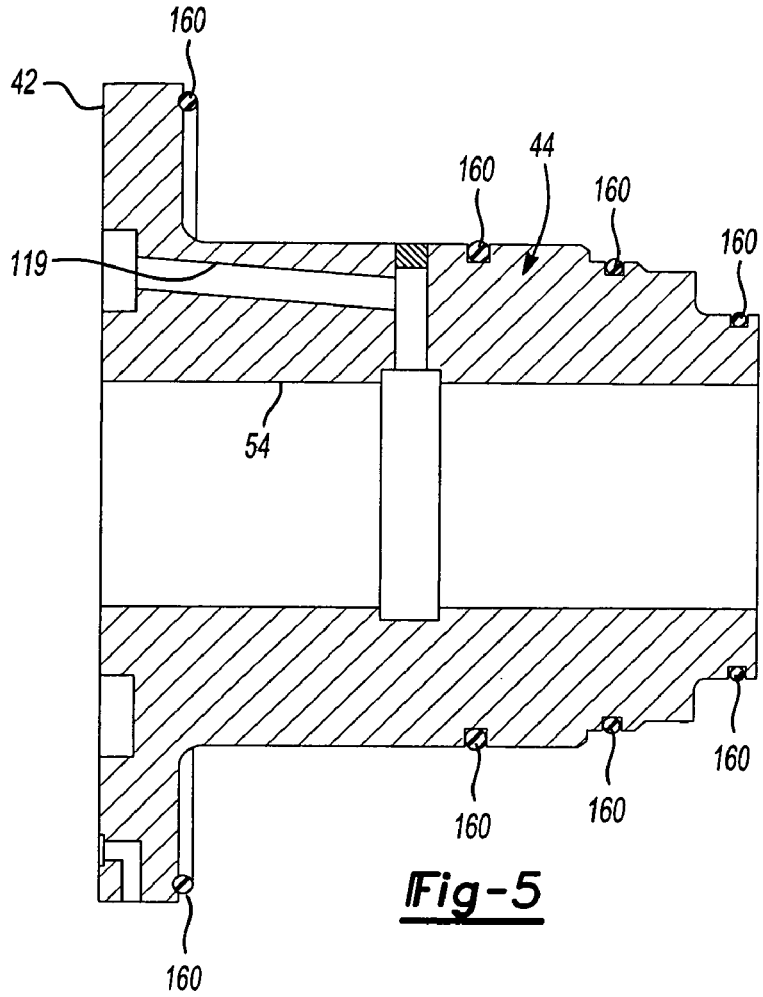
FIG. 5 is a cross sectional view of a neck portion of the turbine device.
Figure 6:
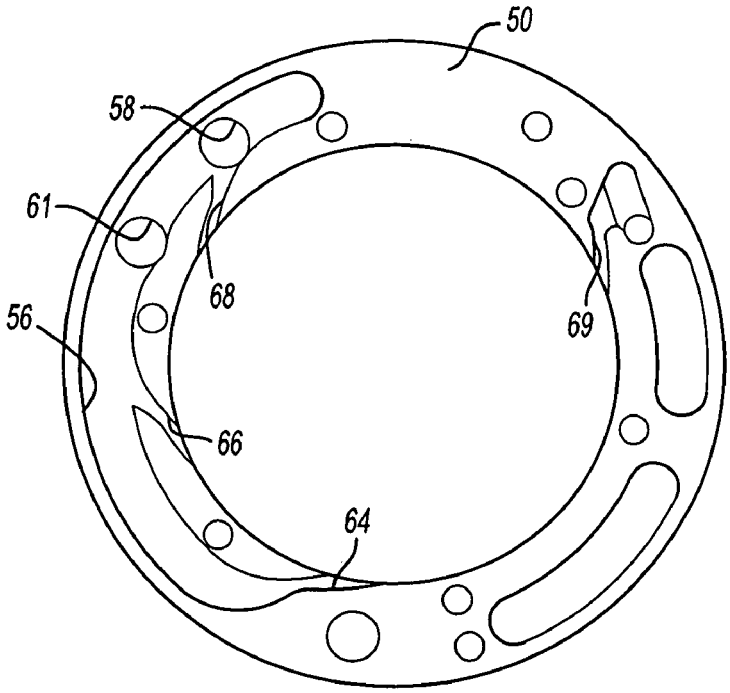
FIG. 6 is an end view of one of the ring plates of the housing of the turbine device illustrating a brake nozzle and at least two inlets.
Figure 7:
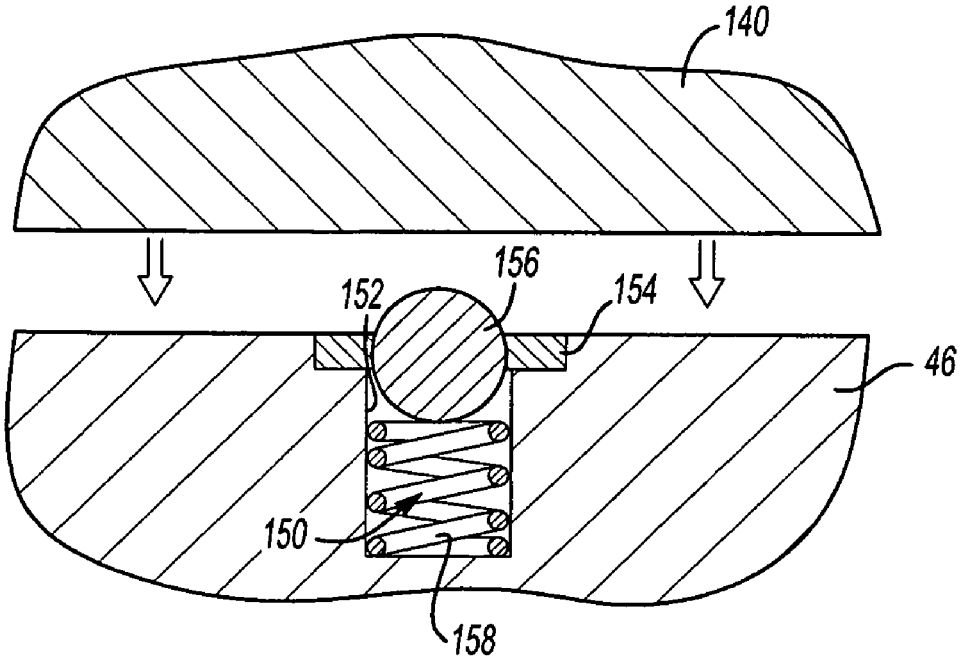
FIG. 7 is a cross sectional and fragmental view of a biasing device disposed in the housing of the turbine device.
Figure 8:
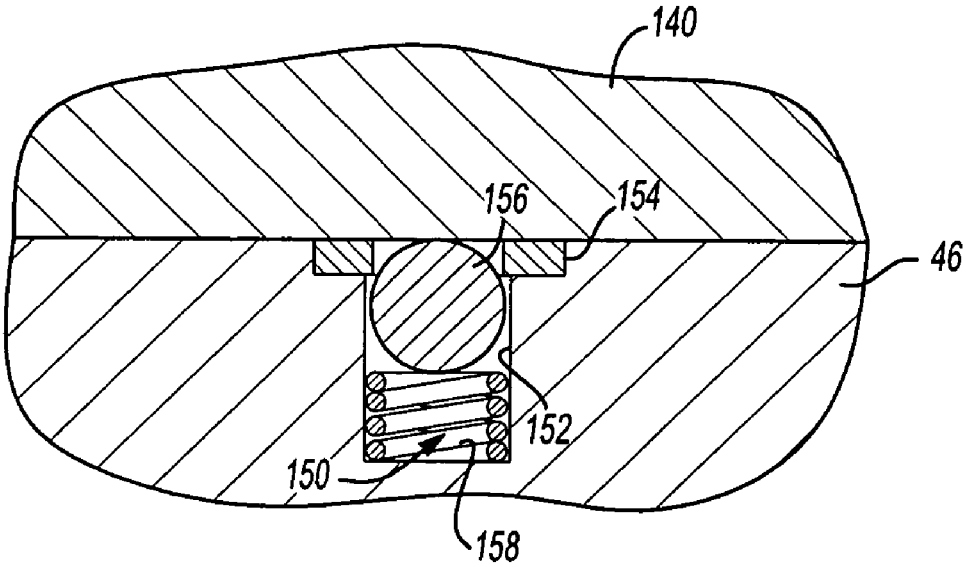
FIG. 8 is a cross sectional and fragmental view of the biasing device of FIG. 7 shown in compressed mode and biased against an air shaping ring to provide surface-to-surface contact.

As best shown in FIGS. 3 and 4, the turbine device 40 include a front plate 42, a neck portion, generally indicated at 44, and defining a tubular body 46 and a base plate 48 having a diameter larger than a diameter of the tubular body 46. The turbine device 40 includes a pair of core plates 50, 52 disposed between the front plate 42 and the neck portion 44. The core plates 50 and 52 and the base plate 48 form a chamber, partially shown at 54 in FIG. 5. An annular intermediate chamber 56 is defined by a cavity formed in one of the plates 50 and covered by the other plate 52 to form the annular intermediate chamber 56. A first inlet 58 is defined in the annular intermediate chamber 56 for delivering fluid, such as, for example gas or air, into the annular intermediate chamber 56 from a fluid source (not shown). The turbine device 40 defines a proximal end 59 and a distal end 60. At least one second inlet 61 is defined in the annular intermediate chamber 56 for delivering fluid into the annular intermediate chamber 56 thereby increasing amount of fluid in the annular intermediate chamber 56 to increase a rotational speed of an atomizing bell unit, generally indicated at 62 and best shown in FIGS. 3 and 4. The atomizing bell unit 62 will be described in great details as the description of the present invention proceeds. The atomizing bell unit 62 is rotated as increased amount of fluid is introduced thereto through a plurality of nozzles, such as, for example Lavalle nozzles 64, 66, and 68 defined in the core plate 52 as best shown in FIG. 6.

The nozzles 64 through 68 are exposed from the annular intermediate chamber 56 and are asymmetrically disposed relative the axis A. The nozzles 64 through 68 are angularly and vortecaly spaced relative to the axis A for rotating the atomizing bell unit 62. Preferably, one of the nozzles 64 through 68 is defined between the first inlet 58 and the second inlet 61 defined in the core plate 52. The nozzles 64 through 68 drive fluid in unison from the annular intermediate chamber 56 for facilitating uniformed application of fluid onto the atomizing bell unit 62. Preferably, the nozzles 64 through 68 are oriented in the circumferential direction over an angle range of approximately 130°, relative to the axis A.

Alluding to the above, the first inlet 58 and the second inlet 61 discharge fluids axially into the intermediate annular chamber 56. Preferably, the first and second inlets 58 and 61 present a circular cross-section with a diameter of 5 mm. The first inlet 58 and the second inlet 61 are exposed to the intermediate chamber 56 to discharge fluid from the intermediate chamber 56. As shown in FIG. 6, the first and second inlets 58 and 61 are located in the upper half of the annular intermediate chamber 56, as best shown in FIG. 6. A brake nozzle 69 is defined in the core plate 52 for driving fluid onto the atomizer bell unit 62 in a direction reverse to the angular direction of fluid driven through the nozzles 64 through 68 thereby decreasing a rotational speed of the atomizer bell unit 62.

As best shown in FIG. 4, the front plate 42 includes connections for bearing air 80, a connection port for breaking air 84, a pair of connection ports for turbine air or turbine air ducts 86, 88, and a connection port for shaping air 90. The aforementioned connection ports 80 through 90 are independently or separately connected to the fluid source. The turbine air ducts 86, 88, which are independent connected to another fluid source (not shown), supply compressed air to a turbine wheel 102 of the atomizing bell unit 62 for driving a shaft 104 connected to the wheel 102. By using two ducts 86, 88 for the turbine air, the performance of the turbine device 40 is improved and more precisely controlled.

The aforementioned connection ports 80 through 90 are radially spaced around a stabilizing member defined by an annular wall 94. The annular wall 94 extends outwardly from the proximal end 59 of the turbine device 40 circumscribing the atomizing bell unit 62 to define a seat, generally indicated at 96 in FIG. 2, for engaging the core member 24 to form a rigidly stabilized connection between the turbine device 40 and the core member 24. The annular wall 94 includes a plurality of air exhaust apertures 98 radially defined in the annular wall 94 and at least one cut-out portion 100 defined therein.

As best illustrated in FIGS. 3 and 4, the shaft 104 of the atomizing bell unit 62 holds and drives an atomizing bell or bell cup 108 disposed at one of the extremities 112 of the shaft 104. The aforementioned turbine wheel 102 is rigidly connected to and circumscribes the shaft 104 at another extremity 114 of the shaft 104. A plurality of U-shaped cut out portions 115 are defined at the extremity 114 of the shaft 104. Each U-shaped cut out portion 115 is aligned with the cut out portion 100 defined in the annular wall 94 to receive a fastener 117 extending through the housing 22 to prevent rotational movement of the shaft 104 during cleaning of the turbine device 40. The shaft 104 is hollow to receive the paint line 26 guided therethrough and exposed through the bell cup 108 to the body of the automotive vehicle. The shaft 104 includes an annular groove 109 defined therein to form an air bearing. Preferably, the annular groove 109 is exposed to an air channel 119 defined in the neck portion 46 to receive the bearing air and to drive the bearing air to the annular groove 109 thereby distributing the bearing air evenly along the shaft 104 to improve alignment of the axial rotation of the shaft 104.

The rigidly stabilized connection defined between the turbine device 40 and the core member 24 maintains a fixed gap between the paint line 26 and the shaft 104 of the atomizing bell unit thereby keeping the shaft 104 at a fixed distance relative to the paint line 26 as the shaft 104 rotates about the axis A, as best shown in FIG. 2. This fixed gap prevents contact between the paint line 26 and the shaft 106 and reduces chances of wear and tear of the paint line 26 by the shaft 104 rotatable at a high speed. The shaft 104 is driven by the turbine air.

A reflector disk, generally indicated at 116, is attached to the turbine wheel 102 to monitor the rotational speed of the bell cup 108. The speed of the bell cup 108 presents an important parameter for atomization of the paint. The speed of the bell cup 108 is measured at the turbine device 40 through the use of the aforementioned reflector disk 116, a fiber-optic cable (not shown), and an opto-electronic converter (not shown). The reflector disk 116 has four reflective surfaces 122 through 128 and four alternating blackened surfaces 130 through 136. This configuration provides for four light pulses being reflected back to the fiber-optic cable with each rotation of the shaft 104. The opto-electronic converter changes these pulses of light into electric signals which are processed by a speed transducer (not shown). The speed transducer compares the current speed of the shaft 104 with the present value by means of the signals and regulates the supply of the turbine air accordingly.

A plurality of blades 130 are connected to and extend outwardly and axially from the turbine wheel 102 to receive bearing air. Each turbine blade 130 is curved, as shown in FIG. 3. Alternatively, (not shown), each turbine blade 130 is non-curved and radially extends from the axis A. A second wheel 132 has a frostoconical configuration and is connected to the shaft 104 below the turbine blades 130. The second wheel 132 includes a vortexly shaped outer surface 134 which produces air turbulence as the shaft 104 is rotated about the axis.

A potential member, such as, for example, an air shaping ring 140 provides a source of direct atomization of the atomized paint particles. The air shaping ring 140 is disposed around one of the terminal ends 118 at the neck portion 46 of turbine device 40 about the bell cup 108. The air shaping ring 140 is known to those skilled in the art and is designed for concentrating the paint as the paint is applied to the body 14 of the automotive vehicle by injecting air from annular channels 141 defined in the neck portion 46 air to the bell cup 108 through annular apertures 143. To improve contact between the neck portion 46 and the air shaping ring 140, a biasing device, generally indicated at 150, is disposed in the neck portion 46 of the turbine device 40 to interconnect the turbine device 40 with the air shaping ring 140 to improve path of continuity and for providing constant surface to surface contact between the turbine device 40 and the air shaping ring 140. In alternative embodiment of the present invention, the potential member is defined by a source of indirect atomization, such as, for example, a plurality of electrostatic probes (not shown).

The biasing device 150 is disposed in a cavity 152 defined in the neck portion 46. The biasing device 150 includes a tubular housing 154, a ball 156, and a spring 158 extending from the cavity 152 to the ball 156 for forcing the ball 156 away from the tubular housing 154 as the air shaping ring 140 is disposed about the neck portion 46 of the turbine device 40.

The atomizer assembly 10 presents an air tight enclosure. To preserve the air inside the atomizer assembly 10 a cover 180 is mechanically connected with the annular wall 30 of the core member 24 extending between the core member 24 and the air shaping ring 140. The turbine device 40 includes a plurality of O-rings 160 disposed respective annular grooves 162. To keep the front plate 42, the neck portion 44, the base plate 48, the core plates 50, 52 at least one centering pin 166 and a pair screw 168 extend through the front plate 42, the neck portion 44, the base plate 48, the core plates 50, 52 to hold the front plate 42, the neck portion 44, the base plate 48, the core plates 50, 52 together.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teaching of the invention without departing from the essential scope thereof. Therefore, it is intended that the invention not to be limited to the particular embodiment disclosed as the best mode contemplated for carrying out the invention, but that the invention will include all embodiments falling within the scope of the appended claims.

The invention claimed is:

1. An atomizer assembly fluidly communicating with a fluid source for coating a part comprising, a housing, a turbine device received by said housing and having a proximal end and a distal end with a tubular member with a plurality of fins rotatably extending therethrough, an atomizing bell affixed to said tubular member at said distal end generally adjacent said turbine device, a core member defining a seat, and said turbine device including a base plate and a front plate having a pair of core plates disposed between said base plate and said front plate, said pair of core plates defining an intermediate chamber for receiving pressurized fluid from a source of pressurized fluid through a first inlet, said intermediate chamber providing pressurized fluid to said plurality of fins through a plurality of spaced nozzles thereby rotating said tubular member, and each of said plates being received by said seat of said core member.

2. An atomizer assembly as set forth in claim 1 wherein said front plate includes a seat and said core member presents an inner surface complementary to engage said seat.

3. An atomizer assembly as set forth in claim 1 wherein said tubular member presents an axis and terminal ends with one of said terminal ends defining a plurality of cut-out portions.

4. An atomizer assembly as set forth in claim 1 including a turbine wheel rigidly connected to and surrounding said tabular member and a plurality of turbine blades connected to said turbine wheel.

5. An atomizer assembly as set forth in claim 4 wherein said first plate presents a plurality of nozzles defined therein for driving fluid in the angular direction onto said turbine blades.

6. An atomizer assembly as set forth in claim 5 wherein said plurality of nozzles is further defined by three nozzles oriented in the circumferential direction over an angle range of at least 130° relative to said axis with said nozzles being asymmetrically disposed relative said axis.

7. An atomizer assembly as set forth in claim 1 including a second inlet defined in said annular chamber for delivering fluid into said annular chamber thereby increasing amount of fluid in said annular chamber to increase the rotational speed of said rotatable turbine wheel as fluid is introduced to said turbine blades through said plurality of nozzles.

8. An atomizer assembly as set forth in claim 1 including a brake nozzle defined in one of said pair of plates for driving fluid to onto said turbine blades in a direction reverse to the direction of fluid driven through said nozzles thereby decreasing rotational speed of said turbine wheel.

9. An atomizer assembly as set forth in claim 8 including a reflector disk connected to said turbine wheel for reflecting light to a sensor thereby monitoring rotational speed of said tubular member.

10. An atomizer assembly as set forth in claim 1 including an air shaping ring disposed around said turbine device for providing shaving air to said atomizing bell there directing atomized paint being atomized by said atomizing bell.

11. An atomizer assembly as set forth in claim 10 including a biasing device extending from said turbine device for interconnecting said turbine device with said air shaping ring thereby providing constant surface to surface contact between said turbine device and said air shaping ring.

12. An atomizer assembly as set forth in claim 11 wherein said biasing device includes a tubular housing, a ball, and a spring for forcing said ball away from said tubular housing as against said air shaping ring is disposed about said turbine device.

* * * * *

UNITED STATES PATENT AND TRADEMARK OFFICE

CERTIFICATE OF CORRECTION

PATENT NO. : 7,721,976 B2
APPLICATION NO. : 11/250303
DATED : May 25, 2010
INVENTOR(S) : Hans J. Nolte et al.

It is certified that error appears in the above-identified patent and that said Letters Patent is hereby corrected as shown below:

An error was made in Claim 8 at Column 7, Line 18:

Please delete "fluid to onto said" and add -- fluid onto said --.

An error was made in Claim 10 at Column 8, Line 7:

Please delete "shaving" and add -- shaping --.

An error was made in Claim 12 at Column 8, Line 16:

Please delete "housing as" and add -- housing --.

Signed and Sealed this

Third Day of August, 2010

David J. Kappos

David J. Kappos
*Director of the United States Patent and Trademark Office*